US006316847B1

(12) United States Patent
Crockett

(10) Patent No.: US 6,316,847 B1
(45) Date of Patent: Nov. 13, 2001

(54) WINCH CONTROL FOR BASKETBALL BACKSTOPS

(76) Inventor: John D. Crockett, 5683 Hwy. 42, Sturgeon Bay, WI (US) 54235

( * ) Notice: Subject to any disclaimer, the term of this patent is extended or adjusted under 35 U.S.C. 154(b) by 0 days.

(21) Appl. No.: 09/439,306

(22) Filed: Nov. 12, 1999

(51) Int. Cl.[7] ..... H01H 47/00

(52) U.S. Cl. ..... 307/125; 318/41; 473/82; 248/326

(58) Field of Search ..... 307/125, 38, 39, 307/40, 41; 318/45, 41, 42, 43, 44; 473/482; 248/326

(56) References Cited

U.S. PATENT DOCUMENTS 3,614,099 10/1971 Sarno .
3,684,104 * 8/1972 Oda et al. ..... 212/47
4,221,996 9/1980 Shimizu et al. .
4,556,199 12/1985 Dansie et al. .
5,361,565 * 11/1994 Bayer ..... 254/292

* cited by examiner

*Primary Examiner*—Josie Ballato
*Assistant Examiner*—Robert L. DeBeradinis
(74) *Attorney, Agent, or Firm*—Andrus, Sceales, Starke & Sawall, LLP

(57) ABSTRACT

A hoisting system is provided for moving a group of basketball backstops via a source of power between a stored position and a use position. Each backstop has a winch with a reversible motor and a circuit for operating each motor in one direction to raise its backstop and in a reverse direction to lower its backstop. A network of manually closable switching mechanisms is connected with the source of power for first indicating the winch motors to be activated, and then operating the winch motors in the one direction or the reverse direction. An array of electromagnetic actuating devices is interconnected with and responsive to the switching mechanisms for enabling the synchronous movement of any number of backstops in the group.

20 Claims, 7 Drawing Sheets

1c
1b
1d
1a
1f
1e
27
27
27
29
29
28
30
26

30
32
36a
36a
28
33
34
79
35
31
36
49
WINCH 1
50
WINCH 2
51
WINCH 3
57
40
41
42
52
WINCH 4
53
WINCH 5
54
WINCH 6
39
ON
FUSE
43
44
45
37
OFF
55
UP
56
DOWN
58
RESET
46
47
48
36a
36a

WINCH
M
R1
R2
R3
R4
R5
R6
R7
R8
R9
R10
R-11
S1
S2
S3
S4
S5
S6
S7
S8
S9
UP
DOWN
RESET
V1
120vac

82
M
27
WINCH
136
135
D1 D2 D3 D4 D5 D6 D7 D8 D9 D10

1 1 C+
R1
B+
59'
60'
2 2 C+
R2 C
61'
3 3 C+
R3 C
62'
4 4 C+
R4 C
63'
5 5 C+
R5 C
64'
6 6 C+
R6 C
40 41 42
1 2 3
S1 S2 S3
43 44 45
4 5 6
S4 S5 S6
46 47 48
UP DOWN RESET
S7 S8 S9
V1
137
R7
R8
R9
R10

WINCH CONTROL FOR BASKETBALL BACKSTOPS

FIELD OF THE INVENTION

This invention relates broadly to a control for a hoisting apparatus used for moving an athletic game goal between a first predetermined position and a second predetermined position. More particularly, the invention pertains to an electrical control for enabling the simultaneous positioning of, at least one, and preferably a group of selected, multiple basketball backstops and their supporting folding structure.

BACKGROUND OF THE INVENTION

Basketball backstops are frequently used in gymnasiums and assembly halls in which basketball games are conducted, but which are also used for other purposes. It is often desirable to move the basketball backstops to positions offering an unobstructed view of some activity, such as a musical performance, speech, or play, occurring in an area of the gymnasium or assembly hall. For such activities, it is desirable to use the same seating as is used when the gymnasium, or assembly hall, is used to conduct basketball games. To leave the basketball backstops in their use positions would result in an obstructed view of non-basketball activities for many patrons. Thus, the basketball stops are, in many modern gymnasiums and assembly halls, mounted from the ceiling to swing between their use positions and hoisted or stored positions adjacent the ceiling or some other non-obstructing orientation. Apparatus for supporting and permitting folding of such basketball backstops is of various types which can generally be classified in three categories: forward-folding, backward-folding, and side-folding.

Each folding apparatus for a particular backstop is provided with a hoisting mechanism having a winding drum with a cable which is reeled in and out to effect the raising and lowering or lateral movement of the backstop. While some of the hoisting mechanisms may be cranked by hand or portable operator, most designs include a reversible electric motor-brake, a gear arrangement and limit switches for setting the upper and lower limits of travel for the folding apparatus. Each hoisting mechanism is typically mounted high on a supporting wall or ceiling adjacent the folding apparatus, and has low voltage electrical wires which are run through a conduit down to a dedicated control at eye level on the gymnasium or assembly hall floor. In order to move the basketball backstop on its folding apparatus, one has to hold a momentary key or flip switch in one of two positions until that single backstop is slowly moved into the desired position. This tedious procedure must be repeated for each backstop and hoisting mechanism and usually requires an operator to walk from one switch to the next, each being generally positioned beneath the backstop. Manufacturers have remained reluctant to provide automatic start/stop on their controls because of their worry regarding liability for damage to the backstop, wall, ceilings, etc., should the control fail to stop at the end of travel. Although there are some hoisting mechanisms which may be activated and deactivated by remote control, it remains necessary to use one control for moving any one basketball backstop. This becomes a time consuming nuisance, particularly if there are multiple, movable backstops to control as is generally the case in a gymnasium or assembly hall.

Accordingly, it is desirable to provide a control for ganging together all of the backstop hoisting mechanisms so as to allow an operator to move the mechanisms and their backstops synchronously as a group. It is also desirable to provide a control which first interlocks a select group of hoisting mechanisms and then employs a single button to move the backstops in unison between stored and use positions. It is further desirable to provide a control which will prevent simultaneous movement of the backstops in opposite directions.

SUMMARY OF THE INVENTION

It is one object of the present invention to provide a control system for coordinating the synchronized movement of multiple winch-controlled objects.

It is also an object of the present invention to provide an electrical control for selectively moving a group of basketball backstops and their folding and supporting apparatus between a retracted, non-use mode, and an extended, play mode.

It is an additional object of the present invention to provide an electrical circuit for tying together a set of winches used to swing and, more specifically, raise and lower a plurality of athletic goals.

It is another object of the present invention to provide an electrical control for converting a gymnasium or assembly hall from a basketball venue to a non-basketball venue offering an unobstructed view of an activity such as a musical performance, play, speech, or the like.

A further object of the present invention is to provide an additional winch control which is easy to install, operate and maintain at a relatively low cost.

Still another object of the present invention is to provide a low voltage, semi-automatic, electrical control which performs reliably over a long period of time.

In one aspect of the invention, there is provided a control for moving at least one and preferably a group of objects, such as athletic equipment, in synchronous movement from one predetermined position to a second predetermined position. The control includes a source of AC power and a multiplicity of actuable winches having reversible motors, each motor being connected with the source of power and one of the objects to be moved. A first plurality of selection switching mechanisms is connected with the source for power of selectively indicating the winches to be actuated, there being one selection switching mechanism for each winch motor. A second plurality of positioning switching mechanisms is interconnected with the selection switching mechanisms for selectively operating the winch motors in opposite directions. A first set of electromagnetic actuating devices is connected between the winch motors and the selection and positioning switching mechanisms and is responsive thereto, there being a one-to-one correspondence between each device and each of the selection switching mechanisms. A second set of electromagnetic actuating devices is connected to the first set of electromagnetic actuating devices and the positioning switching mechanisms. A reset switching mechanism is connected with a source of power for selectively disconnecting the source of power of the first set of electromagnetic actuating devices. A transformer is mounted in a steel housing above one of the winch motors and is plugged into a common receptacle. The transformer is fused on the primaries up in the housing, and is fused on the secondary down on a panel face plate. A power supply is provided for converting the source of the AC power to DC, and includes an on/off switch, a full wave bridge rectifier, a voltage regulator, and a set of electrolytic capacitors, all being interconnected with the transformer so as to provide a steady DC voltage. A set of LEDs is connected to the power supply, the selection and positioning switching mechanisms and the reset switching mechanism for visually indicating the status thereof. The objects to be moved in the preferred embodiment are comprised of a group of basketball backstops. The selection, positioning and reset switching mechanisms are manually closable, pushbutton, spring return switches. The first set of electromagnetic actuating devices are double-pole, double-throw relays having a single energization coil and a pair of normally open contacts. In an alternative embodiment, the first set of electromagnetic actuating devices are latching relays having a pair of energization coils and a pair of normally open contacts. The second set of electromagnetic actuating devices are four-pole, double-throw relays having a single energization coil and four pair of normally open contacts. A reset relay is connected between the source of power and the reset switching mechanism. The reset relay is a double-pole, double-throw relay having a single energization coil and a pair of normally closed contacts. A control cabinet having a mounting board and a Plexiglas face plate is provided. First, second and third modules in the form of plug-in circuit boards are receivable in the mounting board. The first module is comprised of the first set of electromagnetic actuating devices. The second module is comprised of the second set of electromagnetic actuating devices. The third module is comprised of the power supply. The Plexiglas face plate provides a mounting surface for the selection, positioning and reset switching mechanisms, and the on/off switch.

In another aspect of the invention, a hoisting system is provided for moving a group of basketball backstops via source of power between a stored position and a use position. Each backstop has a winch with a reversible motor and a circuit for operating each motor in one direction to raise its backstop and in a reverse direction to lower its backstop. The improvement resides in a network of manually closable switching mechanisms connected with a source of power for first indicating the winch motors to be actuated and then operating the winch motors in one direction or the reverse direction. An array of electromagnetic actuating devices is interconnected with and responsive to the switching mechanisms for enabling the synchronous movement of any number of backstops in the group. A plurality of LEDs is associated with the switching mechanisms and indicates an operating status therefor.

In yet another aspect of the invention, a method is provided for controlling the movement of at least one, and preferably a group of objects, such as basketball backstops from one predetermined position to a second predetermined position, each backstop having a winch with a reversible motor. The method comprises the steps of interconnecting a network of manually closable, pushbutton switching mechanisms and an array of electromagnetic actuating devices responsive to the switching mechanisms in circuit with a power supply having an on/off switch and the winch motors associated with the backstops; turning the on/off switch on; pressing certain of the switching mechanisms so as to indicate these winch motors to be actuated and actuating certain of the electromagnetic actuating devices so that power will flow between certain of the electromagnetic actuating devices and certain of the winch motors; and pressing and holding one of the switching mechanisms to cause certain of the winch motors to move the backstops in synchronous movement from the one position to a second predetermined position.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Reference will now be made to the drawings which depict illustratively in more detail the significant portions of the electrical control of the present invention.

Figure 1:
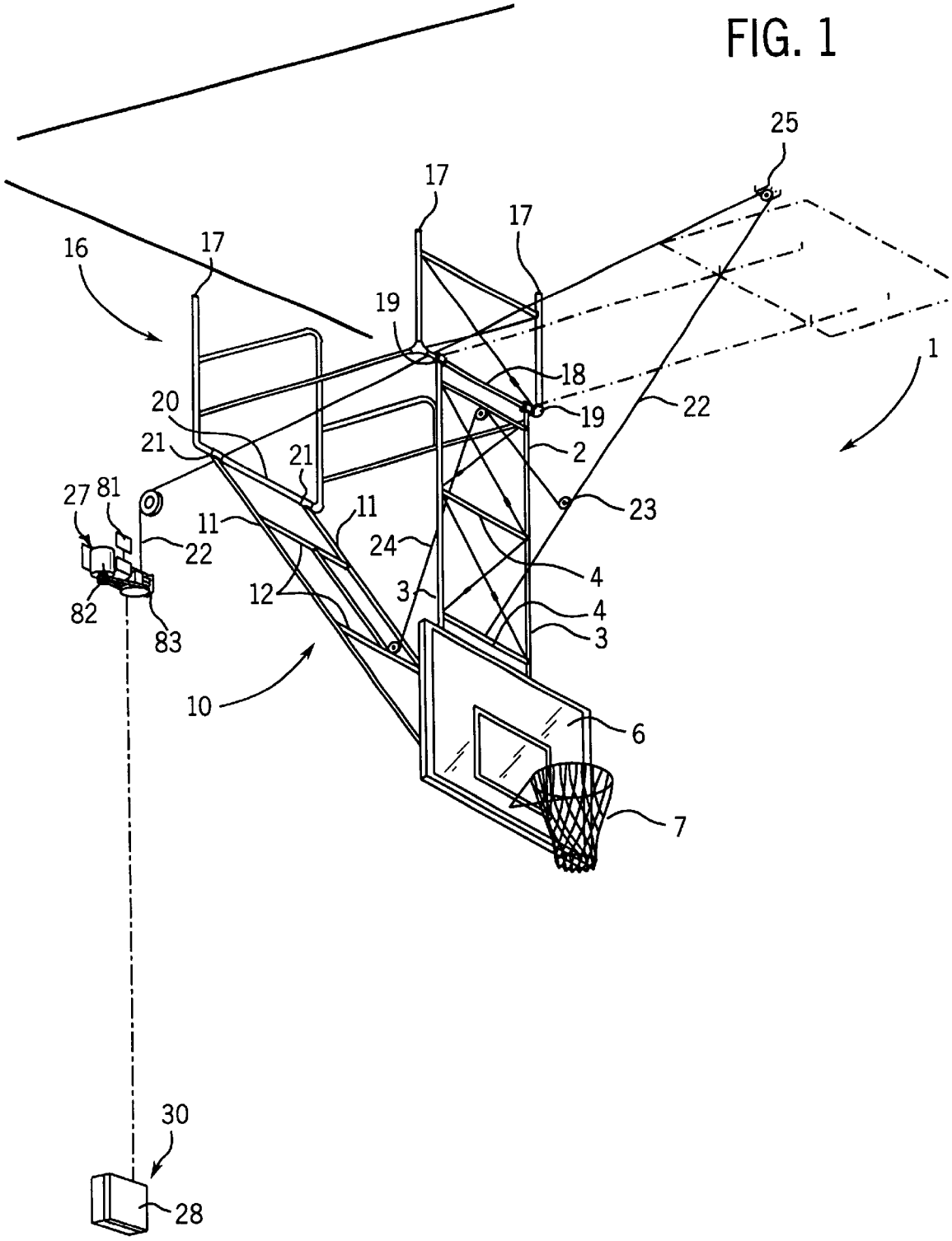
FIG. 1 is a perspective view of a singular, winch-driven, basketball backstop folding and supporting apparatus employing the electrical control embodying the present invention.
Figure 1A:
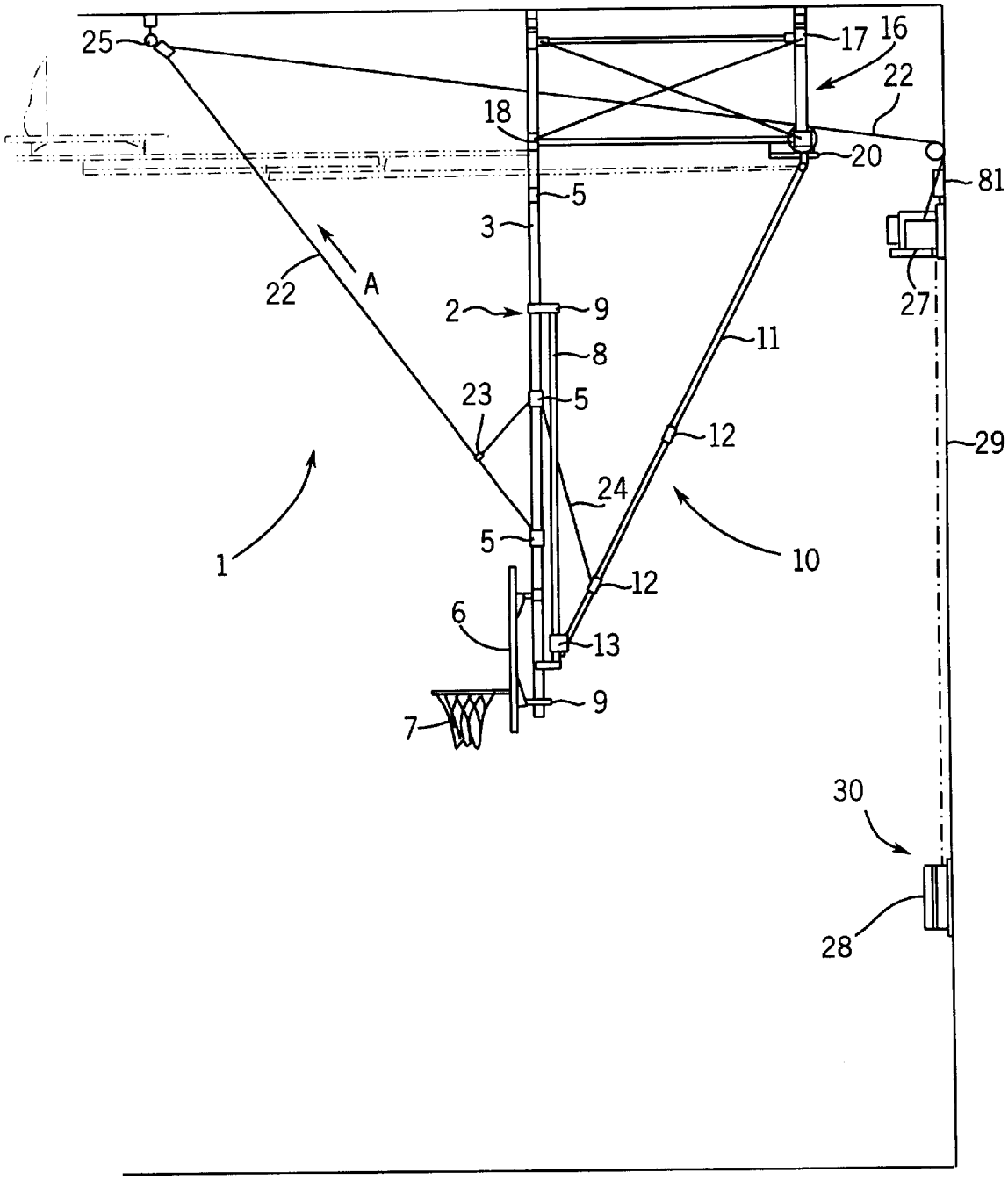
FIG. 1A is a side view of the apparatus shown in FIG. 1.

The present invention is contemplated for use in conjunction with a basketball backstop supporting and folding apparatus as shown in FIGS. 1 and 1A. While the basketball backstop supporting and folding apparatus itself does not form a part of the present invention, it is illustrated to provide a point of reference for the present invention in a practical environment.

Figure 1B:
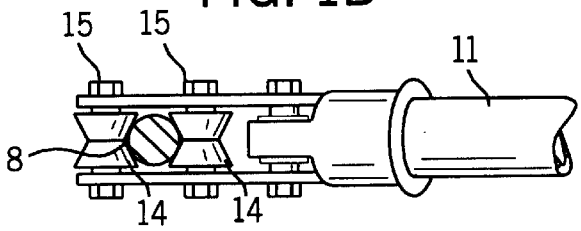
FIG. 1B is an enlarged elevational view showing a guide roller structure in the backstop folding and supporting apparatus.

A basketball backstop supporting and forwardly folding apparatus 1 in a substantially vertical use position is shown as including a first frame structure 2, composed of a pair of side members 3 extending vertically in spaced relation and cross bars 4 extending between the side members 3 in longitudinally spaced relation and secured at their opposite ends of the side members 3 by means of clamps 5. The first frame structure 2 supports at its lower portion a basketball backboard 6 provided with a goal or basket 7. A guide rail 8 is attached by means of clamps 9 to the rear side of each of the side members 3. The apparatus 1 also includes a second frame structure 10 composed of a pair of stay members 11 extending in parallel spaced relation and cross bars 12 extending between the stay members 11 in longitudinally spaced relation. A slider 13 is provided at the lower end of each of the stay members 11 which is best shown in FIG. 1B as including four rollers 14 journaled on respective shafts 15, such as to hold one of the guide members 8 for sliding movement therealong. The apparatus 1 further includes a third frame structure 16 of a rectangular, parallelepiped shape which has upper ends 17 embedded in the ceiling of the gymnasium, a horizontal rod 18 to which the upper ends of the side members 3 of the first frame structure 2 are connected by pivotal connections 19, and another horizontal rod 20 to which the upper ends of the stay members 11 of the second frame structure 10 are connected by pivotal connections 21.

A wire rope 22 extends from one of the crossbars 4 to a pulley 23 and another wire rope 24 extends from one of the cross bars 12 through the pulley 23 and another pulley 25 hung from the ceiling to a hoisting drum (not shown) connected to an electric motor contained in a hoisting mechanism, as will be described later. When the electric motor is placed in operation to pull the wire rope 22 in the direction indicated by the arrow A, the first and second frame structures 2 and 10 rotate in the clockwise direction about their pivotal connections with the sliders 13 sliding along the respective guide rails 8, so that the first frame and second frame structures 2 and 10 are placed in a horizontal, stored position as shown by the phantom lines.

Figure 1C:
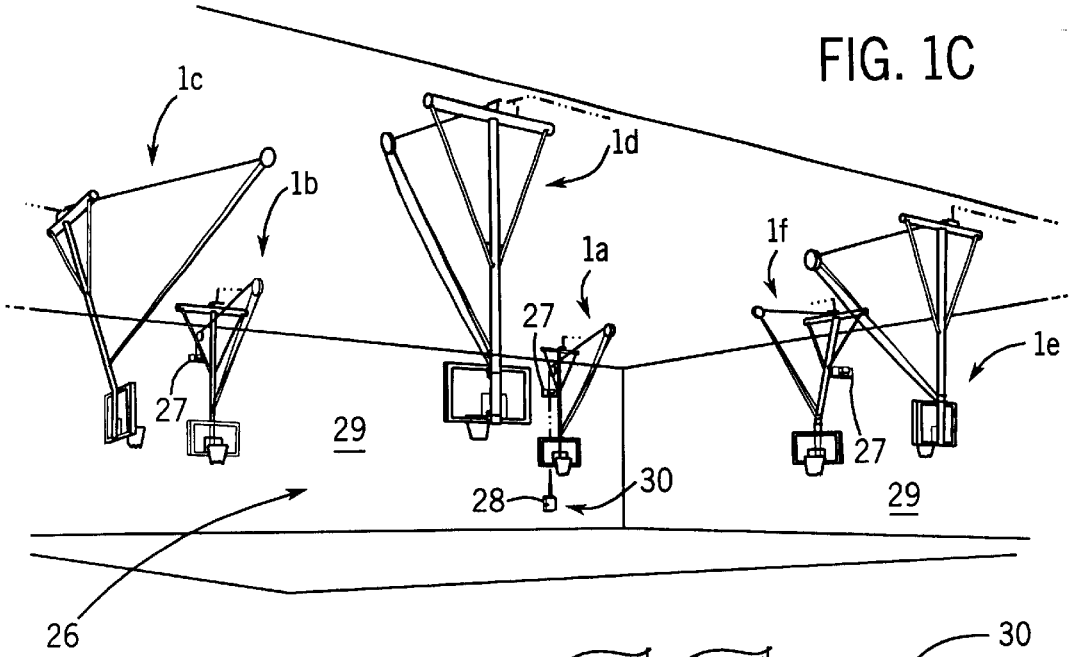
FIG. 1C is a perspective view of a typical gymnasium having six backstop folding and supporting apparatus as shown in FIGS. 1 and 1A equipped with the electrical control of the present invention.

FIG. 1C illustrates a group of six basketball backstop supporting and folding apparatus 1*a–f* spaced apart around the periphery of the gymnasium or assembly hall 26. Each apparatus is provided with its own belt-driven winch or a hoisting mechanism 27 such as a Model 500-B as manufactured by Institutional Products Inc. of Indianapolis, Ind. Because of the nature of the drawing in FIG. 1C, only three winches 27 are shown. Each winch has precision machine bronze and steel gears with ball thrust bearings. The gears run in oil in a sealed gearcase. The winch typically includes a three-quarter horsepower, single phase, 115 volt start, instant reversing motor and rotary gear-type limit switches. All six winches 27 are electrically interconnected in a control cabinet 28 which is suitably mounted on a wall 29 or other supporting surface. Control cabinet 28 is typically locked during basketball play and is, therefore, inaccessible to those without proper authority. Power to move the backstop is regulated by an electrical control 30 embodying the present invention such that any one backstop apparatus 1*a–f* might be swung between a lowered, use position and a raised, storage position. The present invention, however, is particularly noteworthy and useful in enabling the synchronized movement of any selected number of backstop apparatus 1*a–f* from one position to another.

As noted above, the basketball backstop supporting and folding aspects of the present disclosure do not constitute a portion of the inventive concept herein disclosed. For example, any suitable apparatus may be employed to support the backstop for swinging movement. While the preferred embodiment illustrates a forwardly folding apparatus 1, it should be understood that rearwardly, side swinging, or other movable apparatus may be used in accordance with the present invention.

Figure 2:
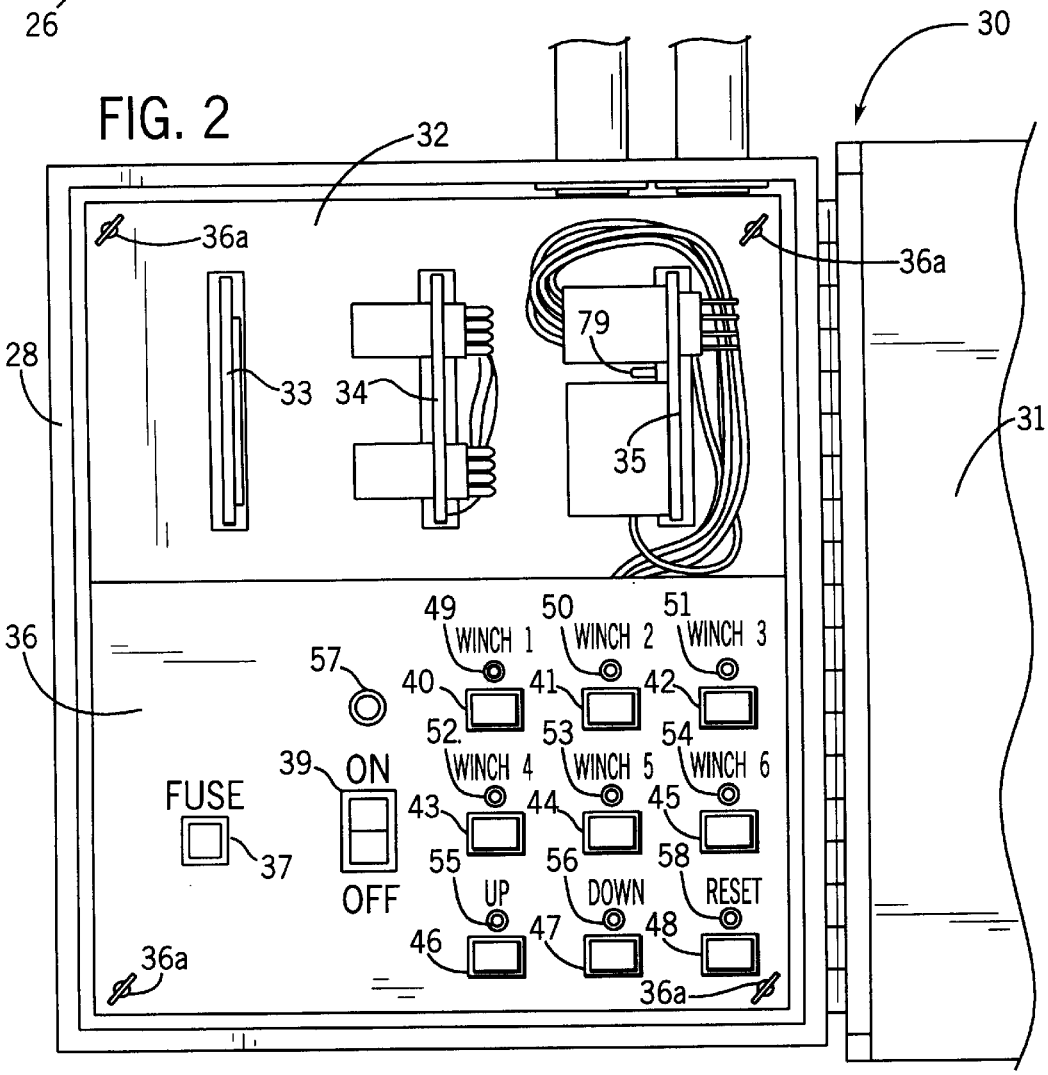
FIG. 2 is a view of a control box with its door swung open to expose elements of the electrical control.

Referring now to FIG. 2, the cabinet 28 is shown with a hingedly-mounted door 31 swung open to expose certain modular components and manually actuated switches when it is desired to operate or inspect the electrical control 30. Cabinet 28 is provided with a mounting board 32 having a set of three spaced apart, vertical socket strips (not shown) for receiving compatible edges for three plug-in boards forming first, second and third modules 33,34,35 respectively. Spaced forwardly of mounting board 32 and positioned below modules 33–35 is a generally planar, rectangular, Plexiglas face plate 36 for mounting an array of components, namely a fuse holder 37 having a fuse 38 (FIG. 4), an on/off rocker switch 39, a series of nine manually closable, normally open, momentary contact, pushbutton, spring return switches 40–48, and ten light emitting diodes (LEDs), 49–58 for signaling a particular operating condition of the on/off and pushbutton switches. In particular, on/off switch 39 has a green LED 57, pushbutton switches 40–45 have yellow LEDs 49–54, pushbutton switches 46–47 have blinking green LEDs 55,56 and pushbutton (reset) switch 48 has a red LED 58. Although not shown in FIG. 2, the back of the Plexiglas face plate 36 carries a set of resistors 49*a*–58*a* (FIG. 4), there being one resistor preceding each LED 49–58.

Each pushbutton switch 40–45 is connected to one of the six winches 27 used for moving the backstop apparatus 1*a–f* between use and play positions. Switches 40–45 are utilized to program the control 30 before any positioning occurs. Once switches 40–45 have been selected, pushbutton switch 46 enables the backstop apparatus 1*a–f* to be moved or raised up while pushbutton switch 47 makes it possible for the apparatus to be moved down or lowered. Pushbutton switch 48 functions to reset or unprogram the control as will be better understood hereafter. Plexiglas panel 36 is held in place by threaded rod and fastener assemblies 36*a* which may be easily removed to inspect, repair, or replace switches mounted thereon.

Figure 3A:
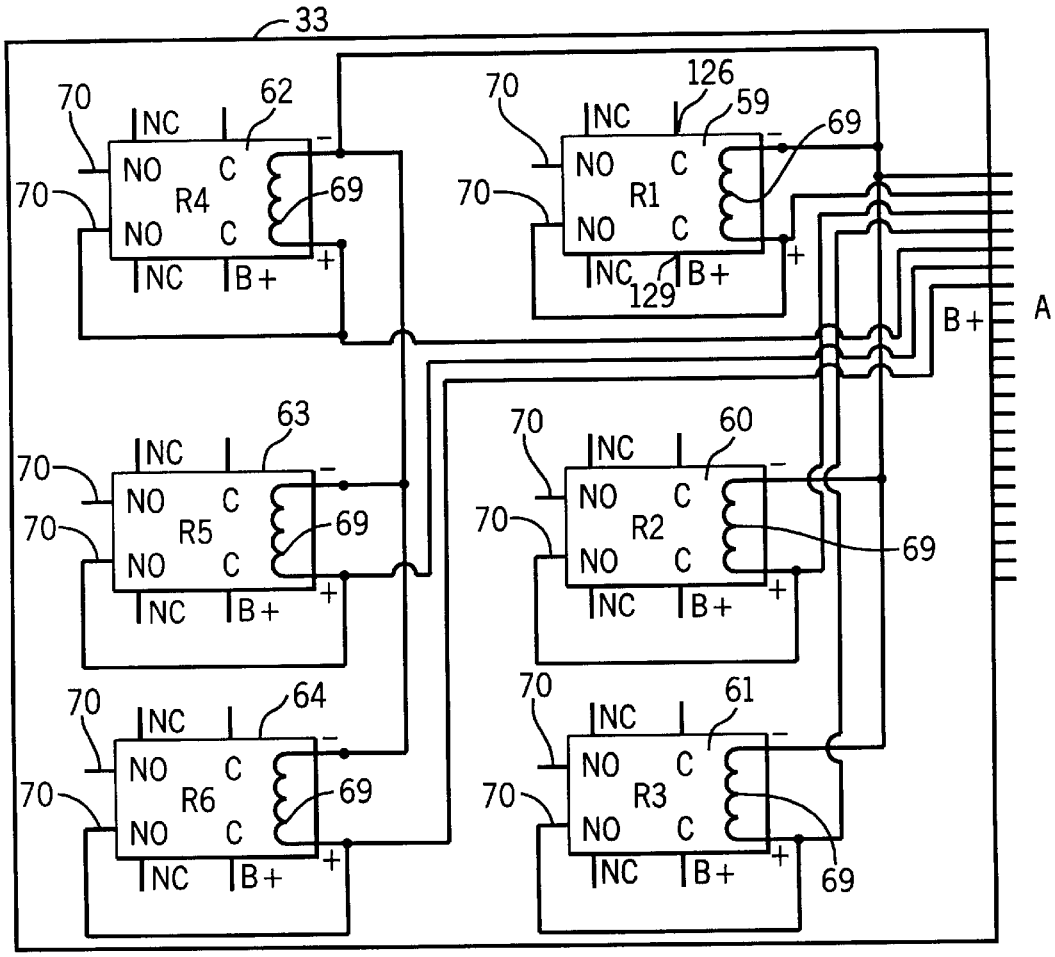
FIGS. 3A, 3B and 3C are representations of individual modules enclosed in the control box of FIG. 2.
Figure 3C:
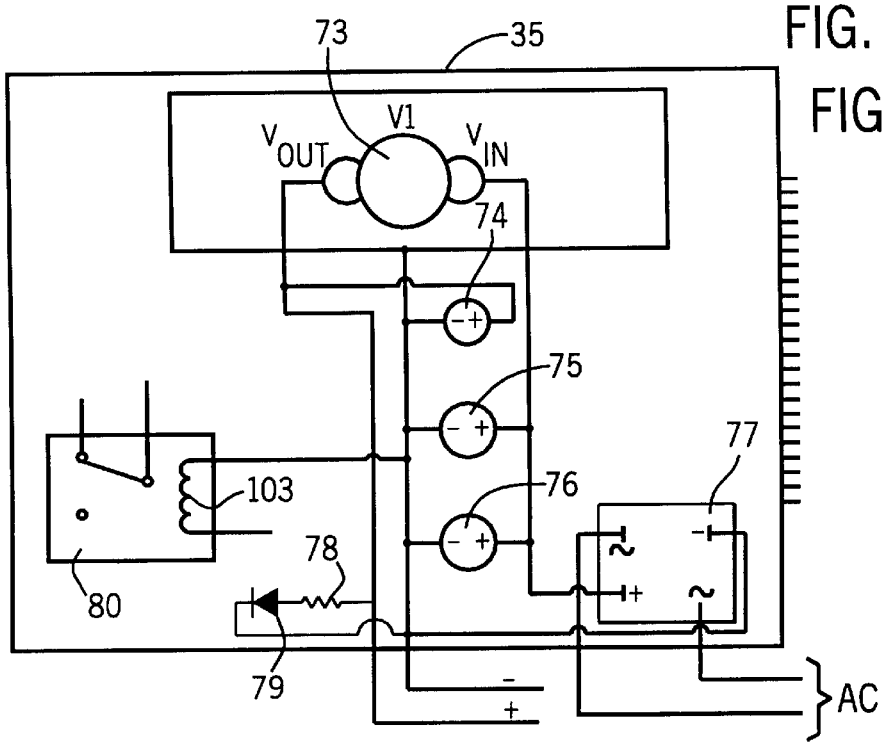
Figure 3B:
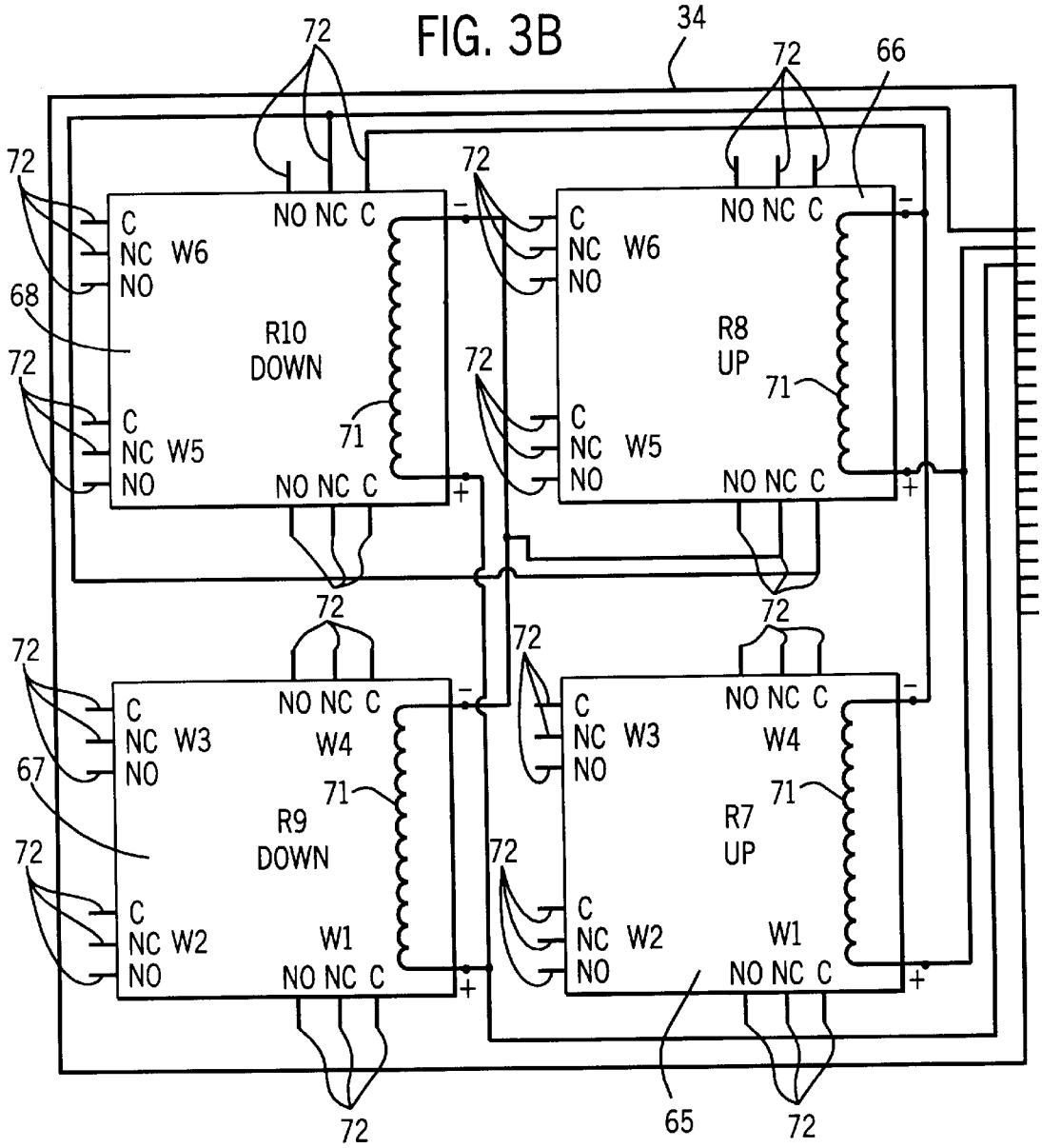

As seen in FIGS. 3A, 3B and 3C, module 33 is comprised of a bank of six double-pole, double-throw (DPDT) winch relays 59–64 which are wired to various pin connections inserted into a corresponding socket strip on mounting board 32. Each relay 65–66 has an energization coil 69 and a set of two normally open contacts 70 and is responsive to a respective push button switch 40–45, when it is desired to select a designated one or group of backstop apparatus 1*a–f*. Module 34 is comprised of four, four-pole, double throw (4-PDT) up and down relays 65–68 which are also wired to pin connections plugged into a corresponding socket strip on mounting board 32. Each up relay 65–66 has an energization coil 71 and a set of four normally open contacts 72, and helps facilitate the raising of selected backstop apparatus 1*a–f*. Each down relay 67–68 is similar to relays 65–66, and aids in the lowering of selected backstop apparatus 1*a–f*. Module 35 includes a voltage regulator 73, a set of three electrolytic capacitors 74,75,76, a full wave bridge rectifier 77, a resistor 78 (FIG. 4), a red light emitting diode (LED) 79 (FIG. 4) and a 12-volt DC, DPDT relay 80, all of which are interconnected to pin connections plugged into another corresponding socket strip on mounting board 32. Module 35 is wired together with a transformer 81 (FIG. 1) mounted in a housing above the winch 27 closest to the control cabinet 28 and forms a power supply for the electrical control 30. It can be appreciated from FIG. 2 that modules 33–35 are sufficiently spaced apart and mounted for easy pull-out removal, inspection/repair and plug-in reinstallation.

Referring back to FIG. 1, there is illustrated one of the six identical winches 27 having a reversible electric motor 82 drivingly connected to a hoisting drum 83 for winding and unwinding the wire rope 22. The winches 27 and the transformer 81 plug into a common receptacle fed by 120 volt AC as represented at 84 on the electrical circuit of FIG. 4. The winches 27 have their own fuse and overload protection, and their own low voltage controls. The winches run 24 volt AC to pull in their relays to run their motors 82. Transformer 81 is fused at 89 on the primaries in the housing of transformer 81 and is fused at 38 on the secondary on control panel face plate 36. The other ends of conductors 87,88 are connected to the transformer 81 which serves to step down and convert the incoming 120 volt AC voltage to approximately 12 volts DC which is applied to the full wave bridge rectifier 77 for rectifying the AC to DC. The rectifier 77 has a pair of alternating current terminals 90,91, and a pair of direct current terminals 92,93. One of the alternating current terminals is connected by a conductor 94 through the fuse 38 to the transformer 81. The other of the alternating current terminals 91 is operatively connected to the transformer 81 by the closing of the normally open, on/off switch 39 in the control cabinet 28. On/off switch 39 is operatively connected with the steady green light emitting diode (LED) 57 to signal its operative state. Connected across a pair of conductors 96,97 connected with the pair of direct current terminals 92,93 is the pair of electrolytic capacitors 74,75 which are employed to filter out the DC pulses from the rectifier 77. The end of conductor 97 opposite the positive direct current terminal 93 is connected to a first pin 73*a* representing positive voltage in the voltage regulator 73 which serves to hold a steady 12 volts DC in the circuit. A second pin 73*b* on the voltage regulator 73 supplies a +12 volts DC via conductor 98 to a positive terminal 99. A third pin 73*c* on the voltage regulator 73 is grounded on conductor 100. The third electrolytic capacitor 76 is connected across conductors 96,97 to stabilize the DC voltage from the voltage regulator 73. Dropping resistor 78 in series with red light emitting diode LED 79 is also connected across conductors 96,97. The red LED 79 on module 35 is designed to be lit when the power supply is operative. The end of conductor 96 opposite the negative direct current terminal 92 defines a negative tie-in point 101 for all LEDs and relays on the control circuit.

Positive terminal 99 is connected by conductor 102 to DPDT 12-volt reset relay 80 having an energization coil 103 and normally closed contacts 104 which provide a source of power or "hot" line via conductor 105 to the normally open pushbutton switches 40–47 and to the normally open pushbutton (reset) switch 48 via conductor 106. When the switch 48 is closed, power will flow via conductor 107 through a resistor 58*a* to one end of red LED 58. The other end of the LED 58 is connected to the negative tie-in point 101 via conductor 108. Also, when switch 48 is closed, reset relay coil 103 is energized via conductor 138 and contacts 104 are opened. Pressing switch 48 will additionally break voltage on conductor 105 and delatch relays 59–64. When the pushbutton switch 40 is closed, power will flow via hot line 109 and conductor 110 through resistor 49*a* to one end of yellow LED 49. The other end of the LED 49 is connected via conductor 111 to the negative tie-in point 101. When pushbutton switch 40 is closed, power is also supplied via conductors 109 and 112 to the positive end of coil 69 on winch relay 59. The negative end of coil 69 is connected to the negative tie-in point 101 via conductor 113. The lower set of contacts 70 on relay 59 will close causing power to flow back to the coil 69 and the LED 49. Although not shown, each of the other pushbutton switches 41–45 is connected in like fashion with the respective yellow LEDs 50–54 and the negative tie-in point 101 In addition, each of the pushbutton switches 41–45 is connected to the plus coil on each of the relays 60–64. The negative end of each coil 69 in relays 60–64 is connected to the negative tie-in point 101 via conductors 113 and 114.

Power supplied to pushbutton switch 40 will also be delivered via conductor 115 to up pushbutton switch 46 and via conductor 116 to down pushbutton switch 47. A conductor 117 has one end connected to up pushbutton switch 46 and leads to the plus coil 71 on up relay 65 via conductor 118, and the plus coil 71 on up relay 66 via conductor 139 as well as through a resistor 55*a* to one end of a blinking green LED 55 via conductor 119. The other end of LED 55 is connected via conductor 120 to the negative tie-in point 101. Similarly, a conductor 121 has one end connected to down pushbutton switch 47 and leads to the plus coil 71 on the down relay 68 via conductor 122, and plus coil 71 on down relay 67 via conductor 140 as well as through a resistor 56*a* to one end of another green blinking LED 56 via conductor 123. The other end of LED 56 is connected via conductor 124 to the negative tie-in point 101.

Each of the six winches 27 is supplied with 24 volt AC and has three conductors variously connected to winch relays 59–64. For example, the first winch 27 has a first conductor 125 connected to the upper common terminal 126 on relay 59. A lead 127 connects the normally open contact 70 of relay 59 with the normally open contacts 72 of up relay 65 and down relay 67. Another lead 128 connects the bottom common terminal 129 of relay 59 with positive tie-in point 99. A second conductor 130 connects winch 27*a* with common terminal 131 on relay 65. A third conductor 132 connects common terminal 133 of relay 67. Relays 65 and 66 are tied together as are relays 67 and 68. Again, for simplicity, it should be understood that similar connections are made on each set of common terminals for each winch relay 60–64 and up and down relays 65–68. Lead 134 connects the bottom common terminals 135,136 respectively, on relays 66 and 68 with the negative tie-in point 101.

Figure 4:
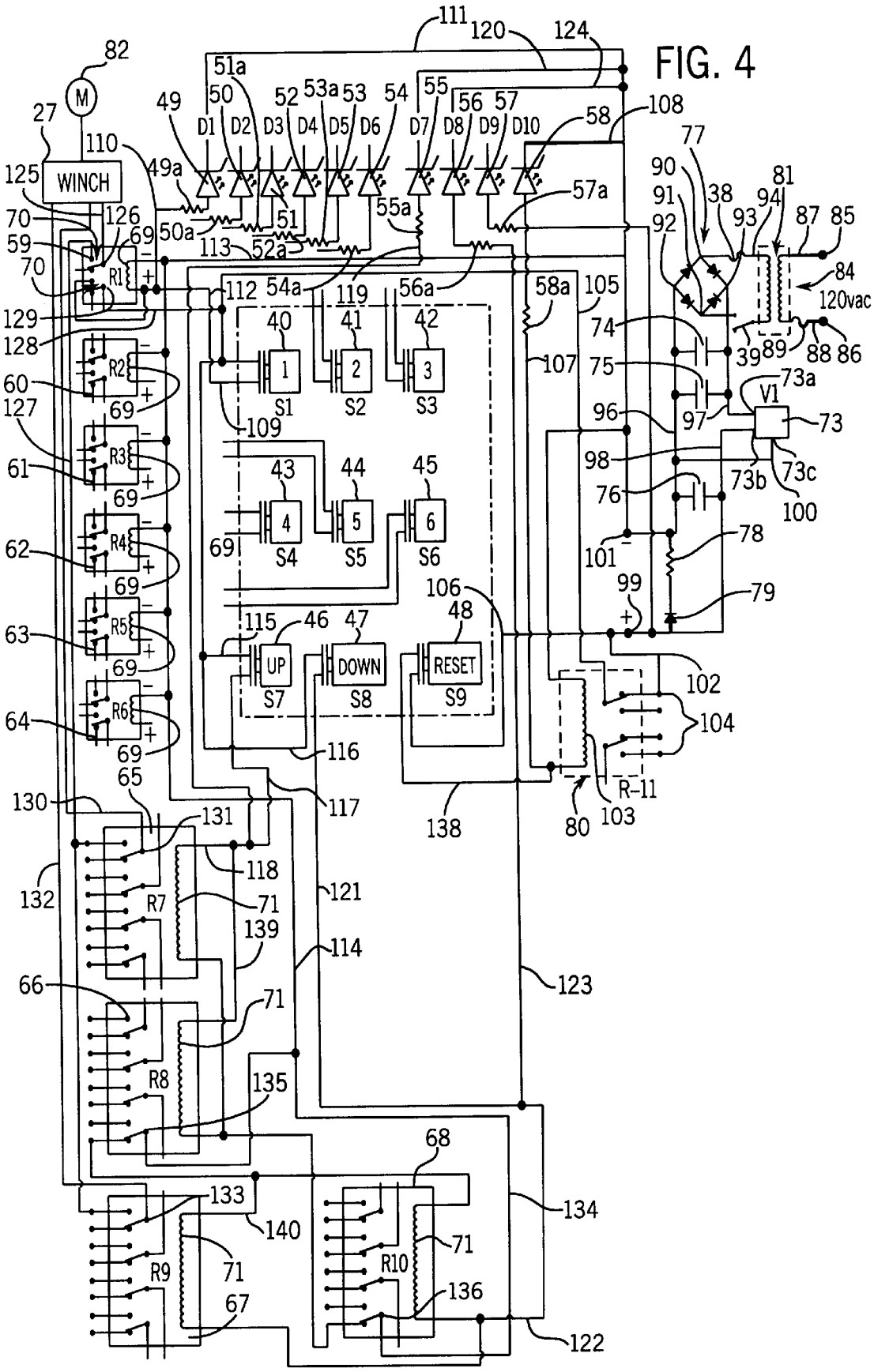
FIG. 4 is an electrical wiring diagram showing the electrical control made in accordance with the present invention.

Each of the components in FIG. 4 is identified with a secondary symbol which is generally in accord with the practice in the control circuit and electrical art and as an aid to understanding the invention. The secondary symbols include the identification of T1 for transformer 81, F1 for fuse 38, D11 for the bridge rectifier 77, C1,C2,C3 for the capacitors 74,75,76, and V1 for the voltage regulator 73. Other secondary symbols include R11 for reset relay 80, S1–S9 for pushbutton switches 40–48, D1–D10 for LEDs 50–58,79, R1–R6 for winch relays 59–64 and R7–R10 for up and down relays 65–68.

In operation, assume it is desired, for example, to swing apparata for backstops 1*a*, 1*c* and 1*f* from a stored position, such as shown in phantom lines in FIG. 1, to a use position shown in solid lines of FIG. 1. An authorized operator first unlocks the control cabinet 28, swinging the door 31 open, as in FIG. 2, and turns on the power via on/off switch 39. This will normally turn on the green LED 57 above the onloff switch 39 and the red LED 79 on module 35 to indicate the power supply is functioning properly. Next, the operator selects the backstop apparatus to be moved by, in this case, pressing pushbutton switches 40,42,44 which will cause the respective yellow LEDs 49,51,53 to glow visually confirming the selection of the backstops to be moved. Pressing the pushbutton switches 40,42,44 will close their normally open contacts, and pull in respective winch relays 59,61,63 which are electrically connected with up and down relays 65–68 as detailed above. After the pushbutton switches 40,42,44 have been pressed, the single, down pushbutton switch 47 is pressed and held so that down relays 67,68 are pulled in. This causes connection of conductors 125,130 so that as switch 47 is held, three of the winch motors 27 will unreel or lower the selected backstop apparatus 1*a*,1*c*,1*f* together in a synchronized motion. The green LED 56 above pushbutton switch 47 will begin blinking to acknowledge the lowering of the selected backstops. When the backstops 1*a*,1*c*,1*f* are lowered to the use position shown in FIG. 1, a limit switch in each hoisting mechanism 27 detects the arrival of the lowered backstops so as to cut off power from the particular winch motor 82 and terminate any further movement. During the lowering movement, the up relays 65,66 are locked out through the normally closed contacts of relay 67,68 so that up and down pushbutton switches 46,47 cannot be held on together. Once the selected backstops have been lowered, the reset pushbutton switch 48 is pressed to open up contacts and cut power to winch relays 59,61,63. This will cause relays 59,61,63 to delatch and turn off their respective yellow LEDs 49,51,53 effectively deprogramming the control 30. Lastly, the on/off switch 39 is shut off putting out the respective green LED 57 and red LED 79 on the power supply. The control cabinet door 31 may be then closed and locked.

Conversely, assume it is desired to raise the lowered backstops 1*a*,1*c*,1*f* from their use position to their stored position. An operator again unlocks the control cabinet 28, swings door 31 open, turns on on/off switch 39 and presses pushbutton switches 40,42,44. Then, up pushbutton switch 46 is pressed and held so that up relays 65,66 are pulled in and the winch motor 82 will lift backstop apparatus 1*a*,1*c*,1*f* together in synchronized motion until the limit switches and hoist mechanisms 27 stop the upper movement at the predetermined storage position. During the raising movement, the down relays 67,68 are locked out through the normally closed contacts 65,616 so that pushbutton switches 46,47 cannot be actuated simultaneously. Finally, reset pushbutton switch 48 is pressed to cut power to winch relays 59,61,63. The control cabinet door 31 is swung shut and locked until further movement of the backstops 1*a*,1*c*,1*f*, is desired.

The electrical control is purposely designed to be semi-automatic, such that an operator must press and hold the up or down switches 46,47 throughout lowering and raising of the backstops. With this feature, the operator is able to immediately cease movement by releasing the switch 46 or 47 in the event of an irregularity such as, for example, a failure in a limit switch.

In the example described above, the value of capacitors 74 and 75 is preferably 1,000 mfd, while the value of the capacitor 76 is preferably 4.7 mfd. The value of resistors 49*a*–54*a*,57*a*,58*a* and 78*a* is preferably 560 ohms, while the value of resistors 55*a*,56*a* is about 180 ohms.

Figure 5:
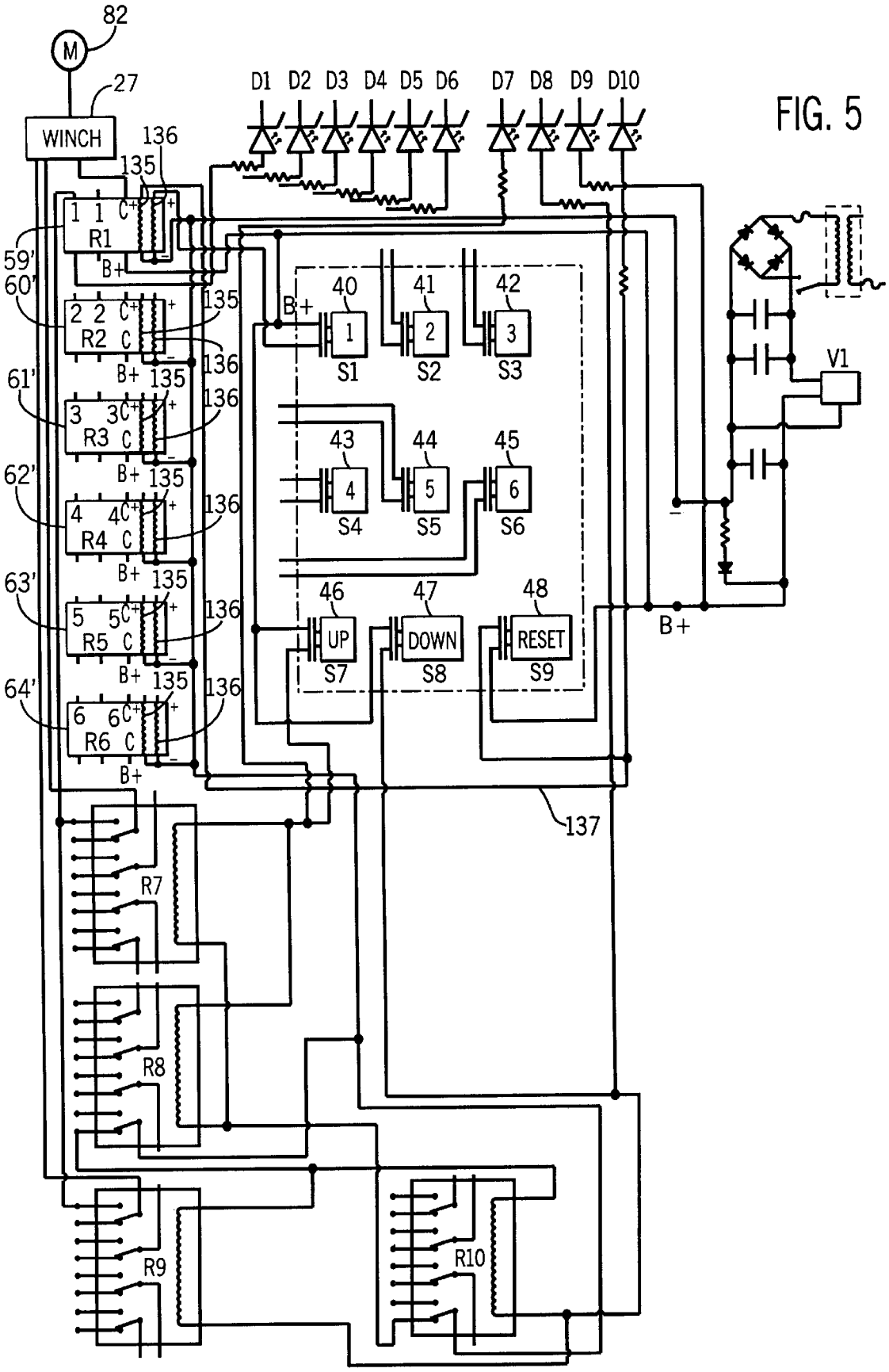
FIG. 5 is an electrical wiring diagram for a first alternative embodiment of the electrical control.

FIG. 5 illustrates a first alternative embodiment of the control circuit which is identical to FIG. 4 except that reset relay 80 is eliminated and winch relays 59–64 are replaced by latching relays 59'–64', each of which has two coils 135,136. In this version, reset switch 48 is connected by a conductor 137 to the second coil 136 on each latching relay 59'–64'. With this design, for example, pressing pushbutton switch 40 engages the first coil 135 on latching relay 59' and latches in the contacts. Pressing reset switch 48 energizes the second coil 136 and unlatches the contacts. Thus, reset switch 48 still functions to deprogram the control as described above.

While the preferred embodiment of FIG. 4 and the alternative embodiment of FIG. 5 have been described using single coil relays and latching relays, it should be understood that other equivalent switching mechanisms such as SCRs or triacs and other solid state devices may also be substituted therefor.

Whereas prior art winch controls for a plurality of backstop apparatus have been embodied in single switches operated one at a time, the present invention excels in providing a network of selection switches and relays ganged together so as to allow the synchronous movement of any one or group of backstop apparata. These switches and relays as well as their power supply and LEDs are centrally positioned and securely located within a locked control cabinet. The present invention may also be employed to simultaneously move any group of objects from one predetermined position to a second predetermined position.

Various alternatives and embodiments are contemplated as being within the scope of the following claims particularly pointing out and distinctly claiming the subject matter regarded as the invention.

I claim:

1. A basketball backstop control for moving a group of basketball backstops in synchronous movement from one predetermined position to a second predetermined position, each basketball backstop having a winch, the control comprising:

a source of AC power;

each winch having a reversible motor, each motor being connected with the source of power and one of the basketball backstops to be moved;

a first plurality of basketball backstop selection switching mechanisms connected with the source of power for selectively indicating the winches to be actuated and the basketball backstops to be moved, there being one selection switching mechanism for each winch motor;

a second plurality of basketball backstop positioning switching mechanisms interconnected with the selection switching mechansims for selectively operating the winch motors in opposite directions;

a first set of electromagnetic actuating devices connected between the winch motors and the selection and positioning switching mechanisms and being responsive thereto, there being a one-to-one correspondence between each device and each of the selection switching mechanisms;

a second set of electromagnetic actuating devices connected to the first set of electromagnetic actuating devices and the positioning switching mechanisms; and a reset switching mechanism connected with the source of power for deactuating the switching mechanisms and electromagnetic actuating devices and selectively disconnecting the source of power from the first set of electromagnetic actuating devices, whereby certain of the selection switching mechanisms are first actuated to indicate a group of basketball backstops to be moved together, and one of the positioning switching mechanisms is then actuated to move the desired group of basketball backstops in one direction in unison, the reset switching mechanism being employed to disable actuation of the selection and positioning switching mechanisms once the basketball backstops have been moved from the one predetermined position to the second predetermined position.

2. The control of claim 1, including a transformer for converting the AC power to a low voltage AC.

3. The control of claim 2, including a power supply for converting the source of AC power to DC, and including an on/off switch, a full wave bridge rectifier, a voltage regulator, and a set of electrolytic capacitors, all being interconnected with the transformer so as to provide a steady DC voltage.

4. The control of claim 3, including a set of LEDs connected to the power supply, the selection and positioning switching mechanisms and the reset switching mechanism for visually indicating the status thereof.

5. The control of claim 3, including a control cabinet having a mounting board and a face plate.

6. The control of claim 5, including first, second and third modules in the form of plug-in circuit boards receivable in the mounting board.

7. The control of claim 6, wherein the first module is comprised of the first set of electromagnetic actuating devices.

8. The control of claim 5, wherein the second module is comprised of the second set of electromagnetic actuating devices.

9. The control of claim 5, wherein the third module is comprised of the power supply.

10. The control of claim 5, wherein the face plate provides a mounting surface for the selection, positioning and reset switching mechanisms, and the on/off switch.

11. The control of claim 1, wherein the selection, positioning and reset switching mechanisms are manually closable, pushbutton, spring return switches.

12. The control of claim 1, wherein the first set of electromagnetic actuating devices are double-pole, double-throw relays having a single energization coil and a pair of normally open contacts.

13. The control of claim 1, wherein the first set of electromagnetic actuating devices are latching relays having a pair of energization coils and a pair of normally open contacts.

14. The control of claim 1, wherein the second set of electromagnetic actuating devices are four-pole, double-throw relays having a single energization coil and four pair of normally open contacts.

15. The control of claim 1, including a reset relay connected between the source of power and the reset switching mechanism.

16. The control of claim 15, wherein the reset relay is a double-pole, double-throw relay having a single energization coil and a pair of normally closed contacts.

17. In a basketball backstop hoisting system for moving a group of basketball backstops together via a source of power between a stored position and a use position, each backstop having a winch with a reversible motor and a circuit board operating each motor in one direction to raise its backstop and in a reverse direction to lower its backstop, the improvement comprising:

a first network of manually closable switching mechanisms connected with the source of power for indicating the winch motors to be actuated and the backstops to be moved a second network of manually closable switching mechanisms connected to the first network for selectively operating the winch motors and backstops in the one direction or reverse direction; and an array of electromagnetic actuating devices interconnected with and responsive to the switching mechanisms for enabling the synchronous movement of any number of backstops in the group, whereby a user initially programs the system by actuating a desired number of switching mechanisms in the first network and then constantly engages a single one of the switching mechanisms in the second network to move the group of backstops together in the one or reverse direction.

18. The improvement of claim 17, including a plurality of LEDs associated with the switching mechanisms and indicating an operating status therefor.

19. A method for controlling the movement of basketball backstops from one predetermined position to a second predetermined position, each object or backstop having a single winch with a reversible motor, the method comprising the steps of:

interconnecting a network of manually closable pushbutton switching mechanisms and an array of electromagnetic actuating devices responsive to the switching mechanisms in circuit with a power supply having an on/off switch and the winch motors associated with the backstops;

turning the on/off switch on;

pressing certain of the switching mechanisms so as to indicate the winch motors to be actuated and the backstops to be moved together, and actuating certain of the electromagnetic actuating devices so that power will flow between certain of the electromagnetic actuating devices and certain of the winch motors; and pressing and holding one of the switching mechanisms to cause certain of the winch motors to move the backstops together in synchronous movement from the one predetermined position to the second predetermined position.

20. In a basketball backstop hoisting system for moving a group of basketball backstops together via a source of power between a stored position and a use position, each backstop having a winch with a reversible motor and a circuit board operating each motor in one direction to raise its backstop and in a reverse direction to lower its backstop, the improvement comprising:

a first network of manually closable primary switching mechanisms connected with the source of power for indicating the winch motors to be actuated and the backstops to be moved, a second network of manually closable primary switching mechanisms connected to the first network for selectively operating the winch motors and backstops in the one direction or reverse direction; and an array of secondary switching mechanisms interconnected with and responsive to the primary switching mechanisms for enabling the synchronous movement of any number of backstops in the group, whereby a user initially programs the system by actuating a desired number of switching mechanisms in the first network and then constantly engages a single one of the switching mechanisms in the second network to move the group of backstops together in the one or reverse direction.

* * * * *

UNITED STATES PATENT AND TRADEMARK OFFICE

CERTIFICATE OF CORRECTION

PATENT NO. : 6,316,847 B1
DATED : November 13, 2001
INVENTOR(S) : John D. Crockett It is certified that error appears in the above-identified patent and that said Letters Patent is hereby corrected as shown below:

Column 12,
Line 1, after "movement" insert -- of a group --.

Signed and Sealed this

Fourteenth Day of May, 2002

*Attest:*

*Attesting Officer*

JAMES E. ROGAN
*Director of the United States Patent and Trademark Office*